US006514353B1

(12) United States Patent
Green, II et al.

(10) Patent No.: US 6,514,353 B1
(45) Date of Patent: Feb. 4, 2003

(54) LABEL REMOVAL SYSTEM AND METHOD THEREOF

(75) Inventors: Newton B. Green, II, Pittsford, NY (US); Collin J. Sirco, Melrose, NY (US); Monica M. Becker, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 09/346,057

(22) Filed: Jul. 1, 1999

Related U.S. Application Data

(60) Provisional application No. 60/105,331, filed on Oct. 23, 1998.

(51) Int. Cl.[7] ..... B08B 1/02; B08B 3/08; B08B 3/14; B08B 9/30; B08B 9/46

(52) U.S. Cl. ..... 134/10; 134/6; 134/18; 134/25.1; 134/25.5; 134/26; 134/30; 134/32; 134/36; 134/63; 134/64 R; 134/113

(58) Field of Search ..... 134/10, 18, 25.1, 134/25.5, 26, 30, 32, 36, 63, 64 R, 113

(56) References Cited

U.S. PATENT DOCUMENTS

| | | | |
|---|---|---|---|
| 2,573,169 | A | 10/1951 | Gerlach et al. |
| 2,640,212 | A | 6/1953 | Hamilton, Jr. |
| 3,868,960 | A | 3/1975 | Cove et al. |
| 3,998,654 | A | 12/1976 | Falaas et al. |
| 4,061,152 | A | 12/1977 | Babunovic |
| 4,322,252 | A | 3/1982 | Plumb |
| 4,325,775 | A | 4/1982 | Moeller |
| 5,217,538 | A | 6/1993 | Buchholz et al. |
| 5,685,053 | A | 11/1997 | Deonarine et al. |
| 5,753,605 | A | 5/1998 | Blatter et al. |

OTHER PUBLICATIONS

Recycling Investment Program Concept Paper to New York State Department of Economic Development Office of Recycling Market Development.

Tarksol, Inc. Website [retrieved from the Internet at http://www.tarksol.org on Jun. 27, 2001].

*Primary Examiner*—Zeinab El-Arini
(74) *Attorney, Agent, or Firm*—Nixon Peabody LLP

(57) ABSTRACT

A label removal system for removing a label with a stock portion and an adhesive from a product includes a stripper, an applicator, a remover, and a transportation system. The stripper sprays a first liquid at the label to strip at least a portion of the stock portion of the label off of the product. The applicator applies a chemical substance on at least a portion of the adhesive and any remaining portion of the label on the product. The remover removes at least a portion of the adhesive and any remaining portion of the label on the product. The transportation system moves the product sequentially from the stripper to the applicator and then to the remover. A method for removing a label with a stock portion and an adhesive from a product includes a number of steps. First, at least a portion of the stock portion of the label off is stripped off of the product by spraying a first liquid at the label. Next, a chemical substance is applied on at least a portion of the adhesive and any remain stock portion of the label. Finally, at least a portion of the adhesive and any remaining portion of the label is removed from the product after the application of the solvent.

54 Claims, 4 Drawing Sheets

LABEL REMOVAL SYSTEM AND METHOD THEREOF

This application claims the benefit of U.S. Provisional Patent Application Serial No. 60/105,331 filed on Oct. 23, 1998 which is herein incorporated by reference.

FIELD OF THE INVENTION

This invention relates generally to recycling systems and, more particularly, to a system and method for removing a label affixed to a product with an adhesive.

BACKGROUND OF THE INVENTION

Although recycling and reuse of products in a variety of different industries is becoming more commonplace, there are still a substantial number of products which could be recycled and reused, but are not. For example, in the electronics industry electronic chips are often transported by affixing the electronic chips onto carrier tape and then winding up the chip-laden carrier tape onto polystyrene reels. Prior to transporting these reels, pressure-sensitive labels are affixed to each of the reels which identify their content, origin, and destination. Once the reels have reached their destination, the carrier tape with the chips on each reel is unwound and the reels are typically discarded even though their useful life is not spent. If the labels on the reels could be removed, then they could be reused several more times.

Unfortunately, a cost-effective way to remove the pressure-sensitive labels from certain products, such as these reels, without warping or otherwise damaging the products has not been found. As a result, these products are not recycled and reused and instead are often disposed of in landfills after a single use. This contributes to the growing volume of solid waste in landfills. Additionally, this requires new products to continually be manufactured which adds to the overall cost of products.

Attempts have been made to develop a system and/or method for removing labels from certain products, such as reels, but these attempts have been unsuccessful for a variety of different reasons. For example, one attempt has involved manually removing labels from the reels. Unfortunately, in addition to being an expensive, slow, and labor-intensive process, this technique has not been particularly effective in removing the labels including the adhesive from a substantial number of reels. Other attempts have involved the use of a variety of different chemicals to remove the labels, including the adhesive, from products. Unfortunately, the chemicals were either ineffective in removing all of the stock of the label and/or all of the adhesive residue, warped or otherwise damaged the reels, were too expensive to use and/or could not be disposed of economically. Accordingly, a cost-effective method for removing a label affixed to certain products, such as a reel, with an adhesive has not been found.

Although the example discussed above relates to the removal of labels from reels used in the electronics industry, the same problems are faced in the removal of labels from products in a variety of different industries which could be reused.

SUMMARY OF THE INVENTION

A label removal system for removing a label with a stock portion and an adhesive from a product in accordance with one embodiment of the present invention includes a stripper, an applicator, a remover, and a transportation system. The stripper sprays a first liquid at the label to strip at least a portion of the stock portion of the label off of the product. The applicator applies a chemical substance on at least a portion of the adhesive and any remaining portion of the label on the product. The remover removes at least a portion of the adhesive and any remaining portion of the label on the product. The transportation system moves the product sequentially from the stripper to the applicator and then to the remover.

A label removal system in accordance with another embodiment of the present invention includes a stripper, an applicator, a scrubber, a washer, and a transportation system. The stripper sprays a first liquid at the label to strip at least a portion of the stock portion of the label off of the product. The applicator applies a chemical substance on at least a portion of the adhesive and any remaining portion of the label on the product. The scrubber scrubs at least a portion of the adhesive and the remaining portion of the label on the product. The washer removes most or all of the residual stock portion, the adhesive, and the chemical substance from the product. The transportation system moves the product sequentially from the stripper, to the applicator, to the scrubber and then to the washer.

A method for removing a label with a stock portion and an adhesive from a product in accordance with yet another embodiment of the present invention includes a number of steps. First, at least a portion of the stock portion of the label is stripped off of the product by spraying a first liquid at the label. Next, a chemical substance is applied on at least a portion of the adhesive. Finally, at least a portion of the adhesive and any remaining portion of the label is removed from the product after the application of the chemical substance.

Another method for removing a label with a stock portion and an adhesive from a product in accordance with yet another embodiment of the present invention also includes a number of steps. First, a first liquid is sprayed at the label to strip off at least a portion of the stock portion of the label. Next the product is at least partially dried and then a chemical substance is applied on at least a portion of the adhesive and any remaining portion of the label. Once the chemical substance is applied, at least a portion of the adhesive and any remaining portion of the label is scrubbed off of the product. Finally, at least the portion of the product where the label was located is washed.

One of the unique aspects of the invention is that the present invention recognized the benefit of combining the best characteristics of several cleaning technologies in a cost-effective integrated system. More specifically, the present invention recognizes that labels can be removed in a cost effective manner by first stripping off at least a portion of the stock portion of the label by spraying a liquid, such as water, and then applying a less corrosive, toxic, and/or expensive chemical substance to the remaining adhesive and stock portion and scrubbing the remaining portion of the label away. As discussed in greater detail earlier, previous methods focused on single cleaning technologies which were ineffective, resulted in damage to the product, were not cost effective, and/or relied upon the use of chemicals which were difficult to handle and/or dispose of. The present invention also recognized the benefit of drying the product after stripping away at least a portion of the stock to optimize the contact between the chemical substance and the adhesive.

Another unique aspect of the present invention is that it will now permit the reuse of a much larger number of products. As a result, fewer products will be disposed of after a single use which should help to further reduce the volume of solid waste being disposed of in landfills. Additionally, the present invention should also reduce the need for the manufacture of as many new products as before, because now many of these products will be able to be reused. As a result, more natural resources will be saved and the overall costs of products should go down.

DETAILED DESCRIPTION

Figure 1:
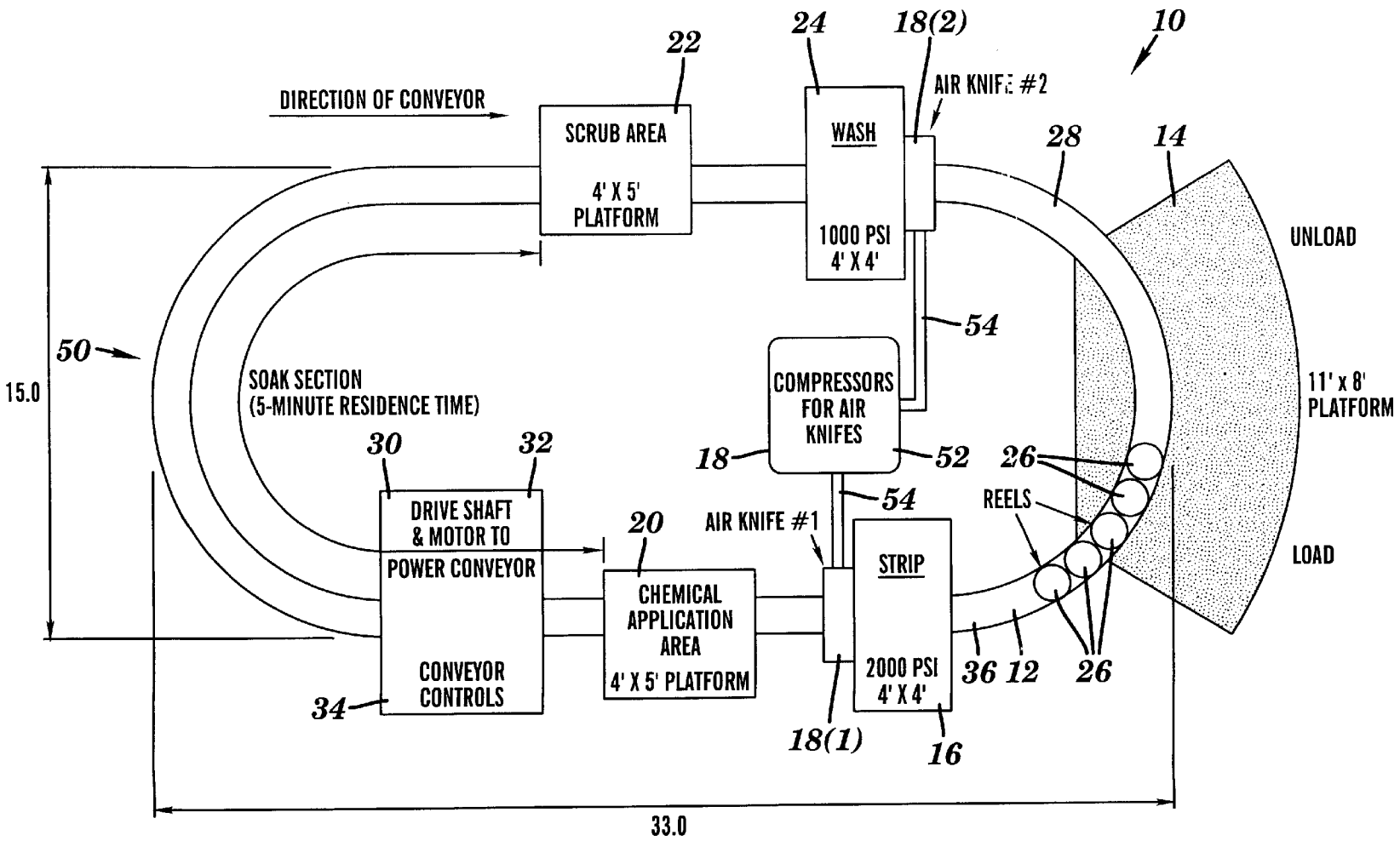
FIG. 1 is block diagram illustrating a label removal system in accordance with one embodiment of the present invention.

A label removal system 10 in accordance with one embodiment of the present invention is illustrated in FIG. 1. This embodiment of the label removal system 10 includes a transportation system 12, a loading/unloading station 14, a stripping station 16, a drying system 18, an application station 20, a removal station 22, and a washing station 24. The present invention provides a number of advantages including providing a method and system for removing a label affixed to a product 26 which combines the best characteristics of a few different cleaning technologies in a cost-effective integrated system. Additionally, with the present invention the volume of solid waste disposed of in landfills should be reduced because more products will now be able to be reused.

Figure 2A:
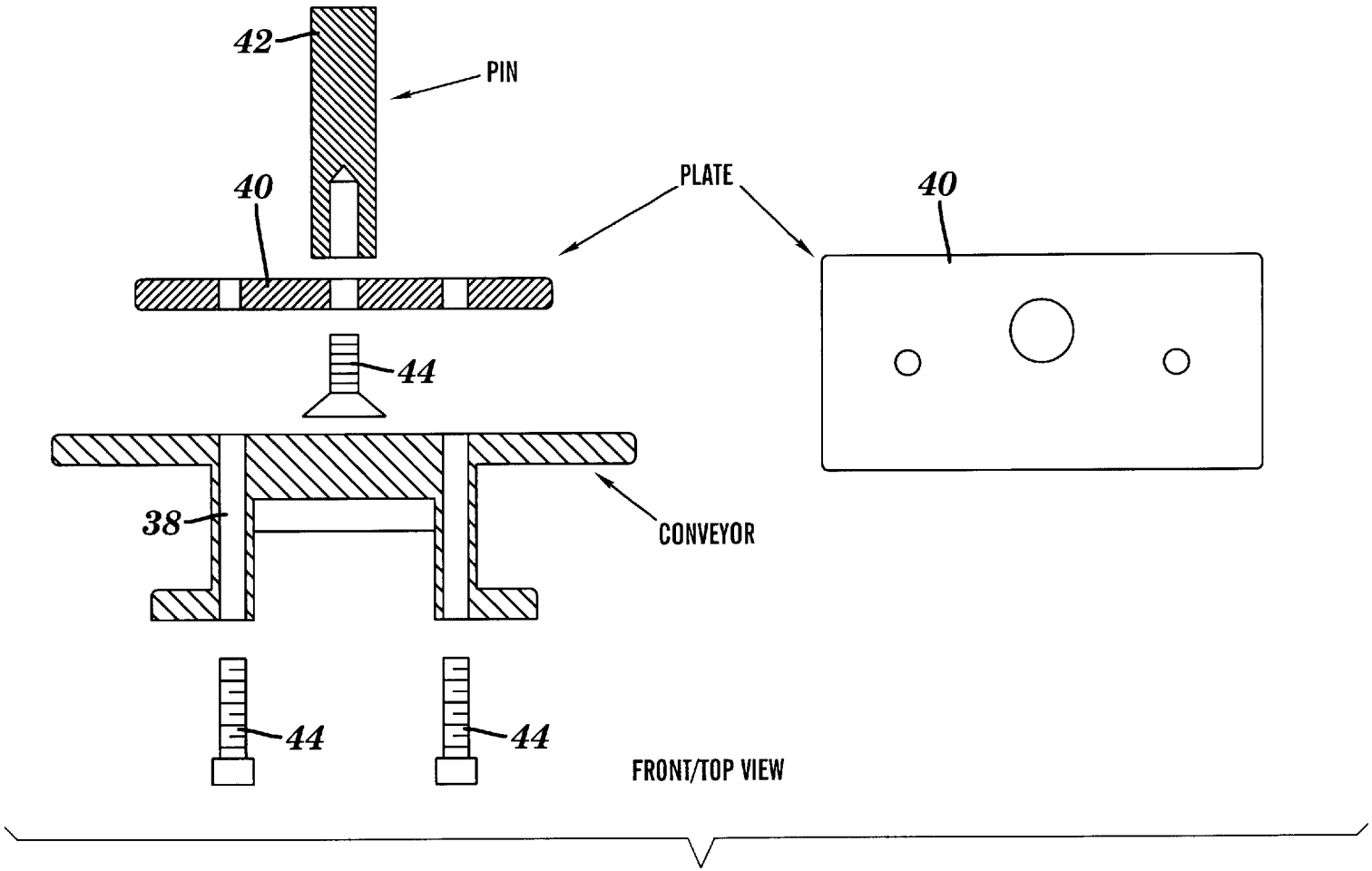
FIG. 2A is a cross-sectional view of a transportation system used in the embodiment of the label removal system shown in FIG. 1.
Figure 2B:
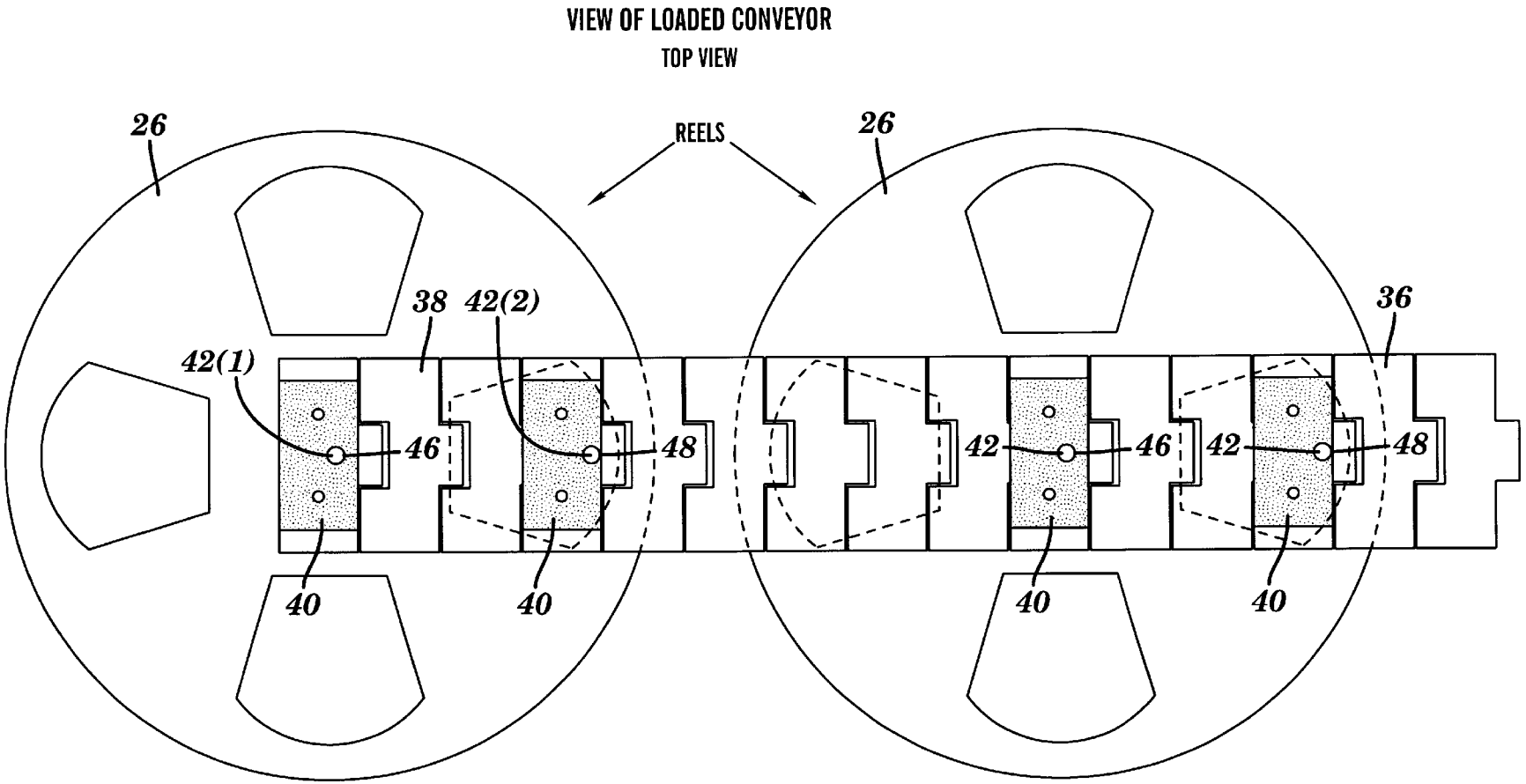
FIG. 2B is a top view of a portion of the transportation system shown in FIGS. 1 and 2A.

Referring to FIGS. 1, 2A, and 2B, in this particular embodiment the transportation system 12 includes an endless conveyor system 28, although other types of transportation systems can be used. Since the parts and operation of conveyor systems 28 are well known to those of ordinary skill in the art, they will not be discussed in detail here. The conveyor system 28 includes a motor 30, a drive shaft 32, connecting gears and components, a conveyor control system 34, and a conveyor belt 36 with a plurality of flat top chain links 38 along with some plates 40 and pins 42, which are all connected together by fastening devices 44, such as screws, to detachably secure the product 26 to the conveyor belt 36 for processing.

Referring more specifically to FIGS. 2A and 2B, in this particular example, one pin 42(1) passes through the center hole 46 in a product 26 and another pin 42(2) passes through another hole 48 in the product 26 and the product 26 rests on the plates 40 secured by each pin 42. As a result, the products 26 are secured to the conveyor system 28 so that the product 26 will not move, rotate or fall off, but the product 26 can still be easily loaded and unloaded. In this particular example, when the product 26 is positioned on the pins 42 and the plates 40, the product 26 is positioned so that the label to be removed faces away from the plates 40 and the conveyor belt 36. Although pins 42 and plates 40 are shown in this example to detachably secure the product 26 to the conveyor system 28, other types of connecting assemblies and mechanisms to secure the product 26 to the conveyor system 28 can also be used.

The transportation system 12 may also include optional drip pans below the conveyor belt 36 to catch fluids dripping off of the product 26 during processing. Preferably, the drip pans are constructed of a material, such as stainless steel or plastic, which is resistant to corrosion.

In this particular embodiment, the endless conveyor system 28 has a length of one hundred-twenty feet and has a nominal line speed of up to fourteen feet per minute so that twelve half reels (products 26) having a diameter of up thirteen inches can be processed per minute, although the length, size, and speed of the conveyor system 28 can vary as necessary for the particular application. The transportation system 12 may also include an extended portion 50 for the conveyor system 28 between the application station 20 and the removal station 22 which permits any chemical substance applied to the adhesive and/or any of the remaining stock portion of the label to soak in, although other techniques for providing soak time may also be used. For example, the transportation system 12 may simply be stopped for a period of time or the product 26 may be removed from the transportation system 12 for a period of time and then the product 26 may be placed back on the transportation system 12 after the period of time has expired. Preferably to remove the adhesive and/or any of the remaining stock portion of the label from products 26, such as polystyrene reels, the extended portion of the conveyor system 28 is designed to permit the chemical substance to soak in for between about fifteen seconds and fifteen minutes, and more preferably about five minutes. This provides adequate time for the chemical substance to work on and react with adhesive and/or any of the remaining stock portion of the label.

Referring back to FIG. 1, in this particular embodiment the loading/unloading station 14 is located adjacent to the transportation system 12 and between the stripping station 16 and the washing station 24. In this particular embodiment, the product 26 is loaded onto and is unloaded from the transportation system 12 manually at the loading/unloading station 14, although the loading and unloading process could be automated using a variety of different types of components, machines, and/or assemblies well known to those of ordinary skill in the art. Additionally in this particular embodiment, the product 26 is inspected manually at the loading/unloading station 14 prior to passing through the label removal system 10 to determine if a label or other item needs to be removed from the product 26 and if the product 26 is saleable or can still be reused, although again this inspection process could be automated using a variety of different types of components, machines, and/or assemblies well known to those of ordinary skill in the art. Product 26 which can not be reused is recycled when possible. Further in this particular embodiment, the product 26 is inspected manually at the loading/unloading station 14 after passing through the label removal system 10 to determine if the label or other item has been removed, although again this inspection could be automated using a variety of different types of components, machines, and/or assemblies well known to those of ordinary skill in the art.

Although not shown, the label removal system 10 may also include an optional electrostatic discharge coating station. As discussed above, in the loading/unloading station 14 the product 26 is inspected to determine if the product 26 is saleable and clean. If the product 26 is saleable and clean, the transportation system 12 may include a separate track for the conveyor system 26 in the loading/unloading station 14 which leads to and transports the product 26 to the electrostatic discharge coating station where an electrostatic discharge coating is applied to the product 26.

The stripping or spraying station 16 is also located adjacent to the transportation system 12 and between the loading/unloading station 14 and the application station 20. The stripping station 16 is designed to remove at least a portion of, and preferably all of, stock portion of the label. Typically, the label is comprised of a stock portion upon which information is printed and which is secured to a product 26, such as a polystyrene reel, by an adhesive. The stock portion is usually paper stock, although the stock portion can be comprised of other materials, such as a plastic or a metal. Since the parts and operation of stripping or spraying stations 16 are well known to those of ordinary skill in the art, they will not be discussed in detail here.

In this particular embodiment, the stripping station 16 includes a plurality of rotary nozzles which deliver a pulsed flow and which are connected by pipes to a pump, a heating system, and a source of liquid, such as water, although stripping stations with other types and/or variations of components and liquids can also be used. Preferably, to remove the stock portion of labels affixed to products, such as polystyrene reels, the stripping system 16 includes four rotary nozzles which each deliver a flow rate of about three gallons per minute (gpm) at pressures ranging between about 500 psig and 5,000 psig and preferably at about 2,500 psig. The stripping system in this particular example also includes a twenty-five horsepower (hp) pump, a heating system which heats the water to a temperature between about eighty degrees Fahrenheit and two-hundred degrees Fahrenheit, and preferably to about one-hundred-sixty degrees Fahrenheit, and pipes which connect the nozzles to the pump, heating system, and the source of liquid, although the number of nozzles, the flow rate, the flow pressure, the liquid temperature, and the horsepower rating of the pump can vary as needed for the particular application. An optional screen spread over a steel grate can be positioned below the nozzles to catch portions of the label as the label is stripped from the product 26.

One of the advantages of the present invention is the discovery that heated water sprayed at high pressure is an effective and inexpensive way to strip at least a portion of the stock portion of the label off of a product 26 and, in particular, off of a polystyrene reel. By removing at least a portion of the stock portion of the label with water, the present invention is able to use less corrosive, toxic, and/or expensive chemical substances along with a scrubbing station to remove the adhesive and any remaining stock portion. The combination of the different removal procedures discussed in this application provides a cost effective and relatively safe method and system for removing labels. Another advantage of the present invention is that the liquid used to strip the stock portion of the label can be captured, filtered, and reused. As a result, the method and system help to conserve water.

A portion of the drying system 18 is located adjacent the transportation system 12 and following the stripping station 16. Since the parts and operation of drying systems 18 are well known to those of ordinary skill in the art, they will not be discussed in detail here. In this particular embodiment, the drying system 18 includes a compressed gas supply 52, such as a source of compressed air, which is connected by pipes 54 to an air knife 18(1), although other types of drying systems with other types of components can also be used. The air knife 18(1) is positioned to direct a gas, such as air, from the compressed gas supply 52 at the product 26 to at least partially dry off the product. Another advantage of the present invention is that the product 26 is dried prior to applying the chemical substance at the application station 20 which promotes optimal contact between the applied chemical substance and the adhesive on the product 26.

The application station 20 is also located adjacent to the transportation system 12 and between the first portion of the drying system 18 and the removal station 22. Since the parts and operation of application stations 20 are well known to those of ordinary skill in the art, they will not be discussed in detail here. In this particular embodiment, the application station 20 includes a sprayer connected to a supply of chemical substance by pipes, although application stations with other types and/or variations of components can also be used. The sprayer is positioned to spray chemical substance on to the adhesive and any remaining stock portion of the label. Although a sprayer is discussed in this example, other systems for applying chemical substances, such as rolling the chemical substance on or dipping the product 26 in the chemical substance can be used. In this particular embodiment, a chemical substance, such as, such as Tarksol, d-Limonene (Chemical Abstract Series No. 5989-27-5), or isoparaffinic hydrocarbon (Chemical Abstract Series No. 64742-48-9), is used and has been found to be particularly effective in helping to remove adhesive and any remaining portion of the stock portion of labels on products 26, such as polystyrene reels, although the particular chemical substance or chemical substances used can vary based upon the particular application. Some of the chemical substances discussed above are insoluble which aids in their recovery after use as discussed below.

The removal station 22 is located adjacent to the transportation system 12 and between the washing station 24 and the application station 20. Since the parts and operation of removal stations 22 are well known to those of ordinary skill in the art, they will not be discussed in detail here. In this particular embodiment, the removal station 22 includes a plurality of rotating brushes and a motor, although other types of removal stations with other types of components can also be used. The brushes, in this example, are positioned to scrub at least the portion of the product 26 where the adhesive and any remaining portion of the stock portion of label is located. In this particular embodiment, the brushes are either cleaned periodically to remove accumulated adhesive and stock or are replaced periodically.

The washing station 24 is located adjacent to the transportation system 12 and between the removal station 22 and the second portion of the drying system 18. Since the parts and operation of washing stations 24 are also well known to those of ordinary skill in the art, they will not be discussed in detail here. In this particular embodiment, the washing station 24 includes a plurality of sprayers connected by pipes to a pump and a source of liquid, such as water, although washing stations 24 with other types and/or variations of components can also be used. Preferably, to remove any remaining residue of adhesive and/or any remaining portion of the stock portion of the label, particularly on a polystyrene reel, a two horsepower pump is used to deliver liquid at fifteen gpm at one-hundred-forty degrees Fahrenheit, although the horsepower rating of the pump, the flow rate, and the liquid temperature can vary as needed for the particular application. Another optional screen spread over a steel grate can be positioned below the washing station 24 and the conveyor system 28 to catch portions of the adhesive and any stock portion of the label washed off of the product 26. Another advantage of the present invention is the ability to reuse the washing liquid and the ability to separate and recover at least a portion of the used chemical substance located in the washing liquid.

Another portion of the drying system 18 is located adjacent the transportation system 12 and following the washing station 24. Again, since the parts and operation of drying systems 18 are well known to those of ordinary skill in the art, they will not be discussed in detail here. In this particular embodiment, another air knife 18(2) is connected by pipes 54 to the compressed gas supply 52 discussed earlier, although this air knife 18(2) could be connected to its own compressed gas supply and drying systems with other types and/or variations of air knives or of components could also be used. The air knife 18(2) is positioned to direct a fluid, such as air, from the compressed gas supply 52 at the product 26 to at least partially dry off the product 26 in preparation for unloading, inspection, pack out, and shipping.

Figure 3:
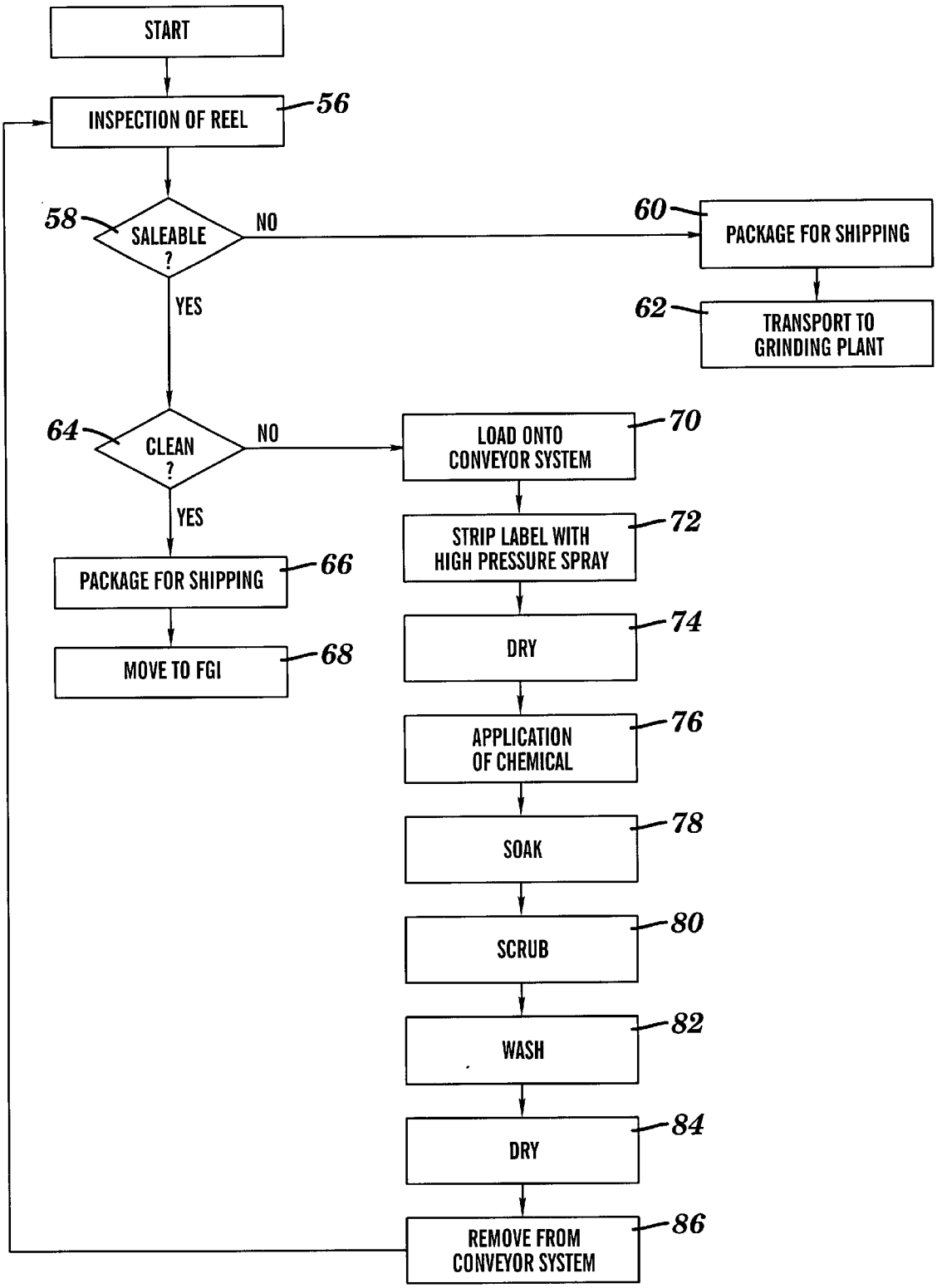
FIG. 3 is a flowchart illustrating a method for removing a label with a stock portion and an adhesive from a product in accordance with another embodiment of the present invention.

The operation of the label removal system 10 will be explained with reference to FIGS. 1–3. Although in this particular example, label removal system 10 and method will be described with reference to the removal of a label from a reel, the system and process will be the same for other types of products 26. First, in step 56 the product 26 is inspected prior to passing through the label removal system 10 and in step 58 a determination is made on whether the product 26 is saleable or reuseable. If the product 26 is not saleable, then the No branch is taken from step 58 and the product 26 is packaged for shipping in step 60 and then in step 62 is transported to a grinding or other type of scrap recycling center. Alternatively, if the product 26 not saleable, then the product 26 may simply be disposed of. Again, in this particular embodiment the inspection process as described above and below is conducted manually, however these steps could be automated if desired.

If in step 58 a determination is made that the product 26 is saleable, then the Yes branch is taken and in step 64 the product is inspected to determine if a label or other item needs to be removed from the product 26. If the product 26 does not need a label removed and thus is clean, then the Yes branch is taken and in step 66 the product is packaged for shipping and in step 68 the product is ready for distribution to the customer and is considered to be finished goods inventory ("FGI").

If the product 26 does need a label removed, then the No branch is taken and in step 70 the product 26 is loaded onto the conveyor system 28. In this particular embodiment, the product 26 is a reel which is detachably secured to the conveyor belt 36 using the pins 42 which pass through holes 46 and 48 in the reel. The transportation system 12 transports the product 26 through the various stations shown in FIG. 1 and described in detail earlier. In this particular embodiment, the transportation system transports the product at about fourteen feet per minute, although the rate at which the product 26 is transported through the label removal system 10 will vary based upon the particular application.

Next, in step 72 the product 26 is transported to the stripping station 16 where at least a portion of the stock portion of the label is removed. Again, preferably, to remove labels affixed to products, such as polystyrene reels, water is heated by a heat source to a temperature of about one-hundred-sixty degrees Fahrenheit and is sprayed at the reels using four rotary nozzles which each deliver a flow rate of about three gallons per minute (gpm) at 2,500 psig and a twenty-five horsepower (hp) pump, although the particular temperature, pressure, and flow rate of the liquid being sprayed will vary based upon the particular application. Again, one of the advantages of the present invention is the combination of different cleaning technologies to remove the labels in a cost effective manner and without damaging the product 26.

As discussed earlier, an optional screen spread over a steel grate is located below the stripping station 16 and catches portions of the label as the label is stripped from the product 26. The stock portion of the labels is collected and disposed of and the liquid, in this example water, is cleaned and recirculated for reuse in the stripping station 16.

Next, in step 74 the transportation system 12 moves the product 26 to the first portion of the drying system 18 where the product 26 is dried with an air knife 18(1). As discussed earlier, another advantage of the present invention is that the product 26 is dried prior to applying the chemical substance to promote optimal contact between remaining adhesive residue and the chemical substance.

Once the product 26 is dried it is transported by the transportation system 12 to the application station 20 where in step 76 the chemical substance is applied to the product 26. In this particular embodiment, approximately 10 milliliters or less of a chemical substance, including, for example, a terpene alcohol based solvent such as environmentally safe Tarksol®, made by Tarksol, Inc., d-Limonene (Chemical Abstract Series No. 5989-27-5), or isoparaffinic hydrocarbon (Chemical Abstract Series No. 64742-48-9), is sprayed onto the product 26, although the quantity of the chemical substance applied as well as the type of chemical substance can vary based upon the particular application. Although in this particular embodiment, the chemical substance is applied by spraying, other methods of application, such as rolling the chemical substance on or dipping the product 26 into the chemical substance, can also be used. Next, in step 78 the chemical substance is allowed to soak into the adhesive residue and any remaining stock portion of the label for a period of time. In this particular embodiment, the chemical substance is allowed to soak for approximately five minutes. Additionally, in this particular embodiment, the soak time is provided while the product 26 travels along the extended portion 50 of the transportation system 12 (between the application station 20 and the removal station 22), although other techniques for providing soak time may also be used, such as simply stopping the transportation system for a period of time or removing the product 26 from the transportation system 12 for a period of time and then placing the product 26 back on the transportation system 12 after the period of time has expired.

Next, in step 80 the product 26 is transported by the transportation system 12 to the removal or scrubbing station 22 where the adhesive and any remaining stock portion of the label is removed. In this particular embodiment, the removal station 22 uses rotary brushes to scrub the adhesive and any remaining stock portion of the label off of the product 26, although other types of removal systems 22 could also be used.

Next, in step 82 the product 26 is transported by the transportation system 12 to the washing station 24 where the product 26 is washed. In this particular embodiment, the product 26 is washed with a liquid, such as water at room temperature, which is sprayed on the product 26 at low pressure, although other types of washing systems could be used using other techniques for washing. In this particular embodiment, the liquid which rinses off of the product 26 is collected and the liquid is reused in the washing station 24 after being filtered or cleaned. Additionally, certain chemical substances may be recovered from the liquid in the washing station 24 and subsequently reused in the application station 20.

Once the product 26 is washed, then in step 84, the product 26 is transported by the transportation system 12 to the second portion of the drying system 18 where the product is dried again. In this particular embodiment, the product 26 is dried with an air knife 18(1), although other types of drying systems could be used, and passed to the loading/unloading station 14.

Next, in step 86, the product is transported by the transportation system 12 to the loading/unloading station 14 where the product 26 is unloaded. Once the product 26 is unloaded, then the product 26 is subject to the process described above beginning again with step 56. A product 26 may require more than one pass through the removal system 10 to remove the label. Accordingly, as described above, the present invention combines the best characteristics of a few different cleaning technologies to provide a cost-effective integrated system for removing labels from products 26.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A method for removing a label with a stock portion and an adhesive from a product comprising:

stripping at least a portion of the stock portion of the label off of the product by spraying a first liquid at the label;

at least partially drying the product by blowing a fluid on to at least a portion of the product for a first period of time;

applying a chemical substance on at least a portion of the adhesive and any remaining portion of the label after at least partially drying the product; and removing at least a portion of the adhesive and any remaining portion of the label off of the product after applying the chemical substance.

2. The method as set forth in claim 1 further comprising inspecting the product prior to the stripping to determine if removal of the label from the product is required.

3. The method as set forth in claim 1 further comprising transporting the product to stations where the stripping, drying, applying, and removing are performed.

4. The method as set forth in claim 3 further comprising loading the product on to a transportation system which transports the product to stations where the stripping, drying, applying, and scrubbing are performed.

5. The method as set forth in claim 1 wherein the stripping further comprises:

collecting portions of the stock portion of the label stripped from the product; and disposing of the collected portions of the stock portion of the label.

6. The method as set forth in claim 5 wherein the stripping further comprises:

collecting the first liquid sprayed on to the label;

cleaning the collected first liquid; and recirculating the cleaned first liquid for reuse in the stripping.

7. The method as set forth in claim 1 wherein the first liquid is at a temperature between about eighty degrees F. and two-hundred degrees F.

8. The method as set forth in claim 1 wherein the fluid comprises a gas.

9. The method as set forth in claim 1 wherein the chemical substance is allowed to soak into at least a portion of the adhesive and any remaining portion of the label for a period of time ranging between about fifteen seconds and fifteen minutes.

10. The method as set forth in claim 1 wherein the removing comprises scrubbing at least a portion of the product.

11. The method as set forth in claim 1 further comprising washing the product with a second liquid after the removing.

12. The method as set forth in claim 11 wherein the washing further comprises:

collecting any remaining portions of the stock portion of the label stripped from the product; and disposing of the collected remaining portions of the stock portion of the label.

13. The method as set forth in claim 12 wherein the washing further comprises:

collecting the second liquid sprayed on to the product and any of the chemical substance on the product;

filtering the collected second liquid and the chemical substance;

separating and recovering at least a portion of the collected chemical substance;

recirculating the cleaned second liquid for reuse in the washing; and reusing the collected substance in the applying.

14. The method as set forth in claim 1 further comprising inspecting the product following the removing to determine if the stripping, drying, applying, and removing need to be repeated.

15. The method as set forth in claim 1 further comprising applying an electrostatic discharge coating to the product.

16. The method as set forth in claim 1 wherein at least one of the stripping, the drying, the applying, and the removing is at least partially automated.

17. The method as set forth in claim 16 wherein the stripping, the drying, the applying, and the removing all at least partially automated.

18. The method as set forth in claim 1 wherein the stripping and drying occur before the applying.

19. The method as set forth in claim 18 wherein the liquid consists essentially of water.

20. A method for removing a label with a stock portion and an adhesive from a product comprising:

spraying a first liquid at the label to strip off at least a portion of the stock portion of the label;

at least partially drying the product by blowing a fluid on to at least a portion of the product for a first period of time;

applying a chemical substance on at least a portion of the adhesive and any remaining portion of the label after at least partially drying the product;

scrubbing at least a portion of the adhesive and any remaining portion of the label off of the product after the application of the chemical substance; and washing at least the portion of the product where the label was located after the scrubbing.

21. The method as set forth in claim 20 further comprising;

loading the product on to a transportation system; and transporting the product using the transportation system to stations where the stripping, drying, applying, scrubbing, and washing are performed.

22. The method as set forth in claim 20 wherein the stripping further comprises:

collecting portions of the stock portion of the label stripped from the product; and disposing of the collected portions of the stock portion of the label.

23. The method as set forth in claim 20 wherein the stripping further comprises:

collecting the first liquid sprayed on to the label;

cleaning the collected first liquid; and recirculating the cleaned first liquid for reuse in the stripping.

24. The method as set forth in claim 20 wherein the first liquid is at a temperature between about eighty degrees F. and two-hundred degrees F.

25. The method as set forth in claim 20 wherein the fluid comprises a gas.

26. The method as set forth in claim 20 wherein the washing comprises spraying a second liquid at the product.

27. The method as set forth in claim 26 wherein the washing further comprises:

collecting any remaining portions of the stock portion stripped from the product; and disposing of the collected remaining portions of the stock portion.

28. The method as set forth in claim 27 wherein the washing further comprises:

collecting the second liquid sprayed on to product and any of the chemical substance on the product;

filtering the collected second liquid;

separating and recovering at least a portion of the collected chemical substance;

recirculating the cleaned second liquid for reuse in the washing; and reusing the collected chemical substance in the applying.

29. The method as set forth in claim 20 further comprising inspecting the product following the washing to determine if the stripping, drying, applying, scrubbing, and washing need to be repeated.

30. The method as set forth in claim 20 further comprising applying an electrostatic discharge coating to the product.

31. The method as set forth in claim, 20 wherein at least one of the spraying, the drying, the applying, the scrubbing, and the washing is at least partially automated.

32. The method as set forth in claim 31 wherein the spraying, the drying, the applying, the scrubbing, and the washing are all at least partially automated.

33. The method as set forth in claim 20 wherein the spraying and the drying occur before the applying.

34. The method as set forth in claim 33 wherein the liquid consists essentially of water.

35. An apparatus for removing a label with a stock portion and an adhesive from a product comprising:

a stripper that sprays a first liquid at the label to strip at least a portion of the stock portion of the label off of the product;

a first drying system that at least partially dries the product by blowing a fluid on to at least a portion of the product for a first period of time;

an applicator which applies a chemical substance on at least a portion of the adhesive on the product and any remaining stock portion of the label after at least partially drying the product;

a remover which removes at least a portion of the adhesive and any remaining stock portion of the label on the product; and a transportation system which moves the product sequentially from the stripper to the applicator, to the first drying system, and then to the remover.

36. The apparatus as set forth in claim 35 further comprising a washer which washes at least a portion of the product with a second liquid.

37. The apparatus as set forth in claim 35 further comprising a second drying system which at least partially dries the product.

38. The apparatus as set forth in claim 37 wherein the first drying system comprises a compressed gas supply connected to a first air knife which is positioned to blow a gas on to the product to dry the product and the second drying system comprises a second air knife connected to the compressed gas supply and which is positioned to blow the gas on to the product to dry the product.

39. The apparatus as set forth in claim 35 wherein the first liquid is water which is at a temperature between about eighty degrees F. and two-hundred degrees F.

40. The apparatus as set forth in claim 35 wherein the chemical substance is selected from a group consisting of terpene alcohol, d-Limonene, and isoparaffinic hydrocarbon.

41. The apparatus as set forth in claim 35 further comprising a transportation system which moves the product sequentially from the stripper to the first drying system, to the applicator and then to the remover.

42. The apparatus as set forth in claim 41 wherein the transportation system comprises a conveyor system.

43. The apparatus as set forth in claim 41 wherein the transportation system transports the product between the applicator and the remover for a time ranging between about fifteen seconds and fifteen minutes to allow the chemical substance to soak into at least a portion of the adhesive and any remaining stock portion of the label.

44. The apparatus as set forth in claim 35 wherein the spraying and the drying occur before the applying.

45. The apparatus as set forth in claim 44 wherein the liquid consists essentially of water.

46. An apparatus for removing a label with a stock portion and an adhesive from a product comprising:

a stripper that sprays a first liquid at the label to strip at least a portion of the stock portion of the label off of the product;

a first drying system that at least partially dries the product by blowing a fluid on to at least a portion of the product for a first period of time;

an applicator which applies a chemical substance on at least a portion of the adhesive and any remaining portion of the label on the product after at least partially drying the product;

a scrubber which removes at least a portion of the adhesive and any remaining stock portion of the label on the product;

a washer that washes at least a portion of the product where the stock portion and the adhesive are located with a second liquid; and a transportation system which moves the product sequentially from the stripper, to the first drying system, to the applicator, to the scrubber and then to the washer.

47. The apparatus as set forth in claim 46 further comprising a second drying system which at least partially dries the product, the transportation system moving the product to the second drying system following the scrubber.

48. The apparatus as set forth in claim 47 wherein the first drying system comprises a compressed gas supply connected to a first air knife which is positioned to blow a gas on to the product to dry the product and the second drying system comprises a second air knife connected to the compressed gas supply and which is positioned to blow the gas on to the product to dry the product.

49. The apparatus as set forth in claim 46 wherein the first liquid is water which is at a temperature between about eighty degrees F. and two-hundred degrees F.

50. The apparatus as set forth in claim 46 wherein the chemical substance is selected from a group consisting of terpene alcohol, d-Limonene, and isoparaffinic hydrocarbon.

51. The apparatus as set forth in claim 46 wherein the transportation system comprises a conveyor system.

52. The apparatus as set forth in claim 46 wherein the transportation system transports the product between the applicator and the scrubber for a time ranging between about fifteen seconds and fifteen minutes to allow the chemical substance to soak into at least a portion of the adhesive.

53. The apparatus as set forth in claim 46 wherein the spraying and the drying occur before the applying.

54. The apparatus as set forth in claim 53 wherein the liquid consists essentially of water.

* * * * *